US005220759A

United States Patent [19]

Hossli

[11] Patent Number: 5,220,759

[45] Date of Patent: Jun. 22, 1993

[54] CURTAIN WALL SYSTEMS HAVING IMPROVED VERTICAL FRAME MEMBER

[75] Inventor: Robert I. Hossli, Pittsburgh, Pa.

[73] Assignee: Robertson-Ceco Corporation, Boston, Mass.

[21] Appl. No.: 780,100

[22] Filed: Oct. 18, 1991

[51] Int. Cl.[5] ..... E04B 2/88

[52] U.S. Cl. ..... 52/235; 52/483; 52/510

[58] Field of Search ..... 52/235, 483, 400, 510, 52/481

[56] References Cited

U.S. PATENT DOCUMENTS 3,182,766 5/1965 Ferrell ..... 52/235
4,866,896 9/1989 Shreiner ..... 52/235
4,899,508 2/1990 Biebuyck ..... 52/235
5,065,557 11/1991 Laplante ..... 52/235

*Primary Examiner*—Richard E. Chilcot, Jr.
*Assistant Examiner*—Beth A. Aubrey
*Attorney, Agent, or Firm*—Reed Smith Shaw & McClay

[57] ABSTRACT

A curtain wall structure of the type incorporating laterally displaceable, vertical spline means for releasibly securing horizontally adjacent panels to supporting structure. A vertical gap is presented between adjacent panels through the spline means is accessible. The support structure includes improved vertical frame means arranged to accommodate misalignments between spline means and the frame means such that the spline means remains accessible through the gap.

15 Claims, 4 Drawing Sheets

CURTAIN WALL SYSTEMS HAVING IMPROVED VERTICAL FRAME MEMBER

BACKGROUND OF THE INVENTION

1. Field of the Invention

This invention relates to curtainwall systems, and more particularly to improvements in curtainwall systems having readily replaceable panels.

2. Description of the Prior Art

A curtain wall structure is known incorporating a dry seal system to preclude ingress of water and the infiltration of exterior air. The wall system includes displaceable vertical splines which releasibly retain the opposite edges of the wall panels. The splines are secured to vertical frame means disposed inboard of the wall panels, by fastening means accessable through a gap presented between adjacent panels. When a panel is damaged and is to be replaced, the damaged panel is released for removal by releasing and laterally displacing the splines which retain the opposite panel edges. The arrangement is unique in that it allows removal and installation of panels in a non-sequential manner. Such a system is disclosed in copending application Ser. No. 07/607,526 filed Nov. 1, 1990, now U.S. Pat. No. 5,065,557 and assigned to the assignee of the present invention.

The above-referred to curtain wall system has virtually no lateral adjustment capability for accommodating misalignment between the gap at the panel joint and the vertical frame means. Such misalignment can occur if the supporting steel is bowed or laterally misaligned. Such misalignment may cause the vertical frame means to be located off center with respect to the gap at the panel joint.

SUMMARY OF THE INVENTION

The principal object of this invention is to provide improvements in a curtain wall system that allows individual panels to be removed and installed in a non-sequential manner.

Another object of this invention is to provide vertical frame means adapted to accommodate misalignment between the gap and the vertical frame means.

Still another object of this invention is to provide vertical frame means adapted to accommodate the aforesaid misalignment thereby maintaining the spline, the spline fastener means, and the cap means centered with respect to and accessible at the gap.

In its broadest aspects, the present invention relates to and provides improvements in a vertical joint between horizontally adjacent wall panels of a wall structure. The wall structure comprises panels having inner and outer panel faces and presenting spaced-apart vertical edges with a vertical gap therebetween. Means disposed at the vertical edges of the inner face provide vertical recesses open at and extending inwardly from the vertical edges. Vertical spline means is provided spanning across the vertical gap, engaging the vertical recesses and being moveable out of engagement with either of the recesses thereby releasibly retaining the panels.

The present improvement comprises fastening means accessible through the vertical gap, releasibly securing the vertical spline to structure inboard of the wall panel; and the structure including vertical flange means in flush engagement with the spline means as secured thereto by the fastening means. The flange means has a width sufficient to accommodate a lateral misalignment between the vertical gap and the flange means.

Further, in accordance with the present invention, a frame member is provided for use in a curtain wall structure. The frame member comprises a central plate having opposite sides and inner and outer faces. U-shaped arms are provided, each connected along one of the opposite sides and extend away from the outer face. The U-shaped arms have open ends adjacent to the inner face. Flange means is provided, spaced from and generally parallel with the central plate and intermediate of the U-shaped arms. Connecting means is provided connecting the flange means to the central plate.

DESCRIPTION OF THE PREFERRED EMBODIMENT(S)

Figure 1:
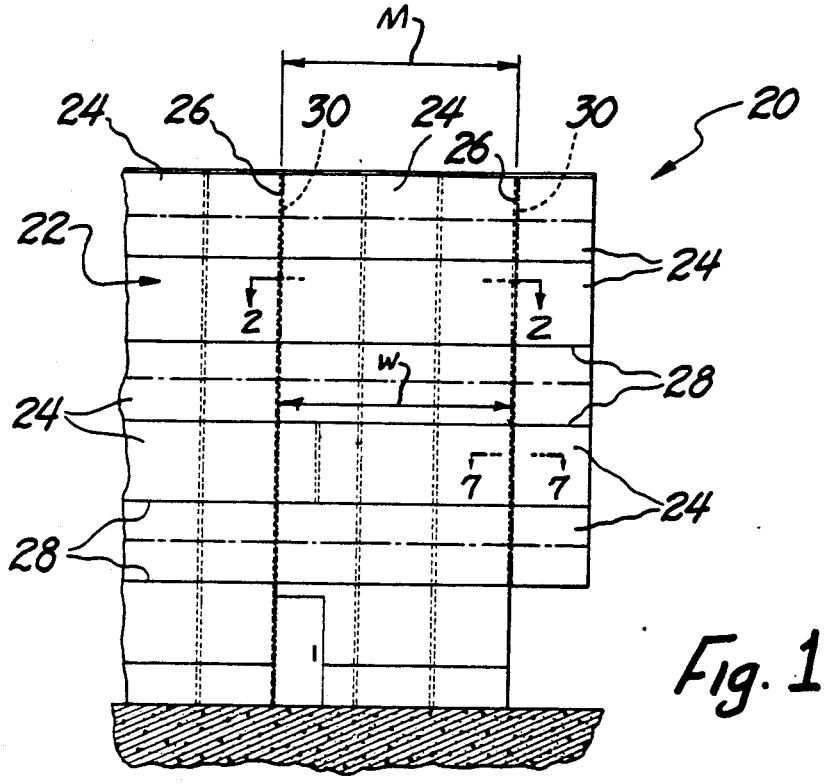
FIG. 1 is an elevation view of a building incorporation the curtain wall construction of this invention.

Referring to FIG. 1, there is illustrated a three story building 20 with an exterior wall structure 22, assembled with horizontally adjacent and vertically adjacent wall panels 24 which present vertical joints 26 and horizontal joints 28 While the wall panels 24 are illustrated extending horizontally between spaced-apart columns 30, they could, if desired, extend vertically.

Figure 2:
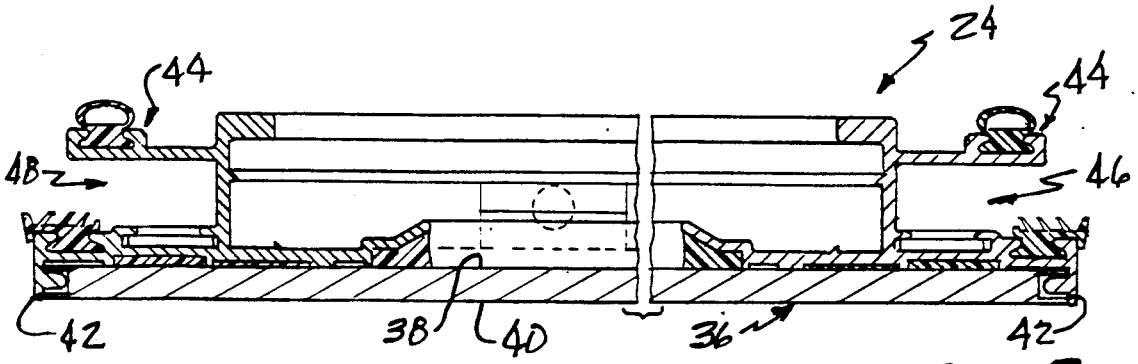
FIG. 2 is a broken cross-sectional view, taken along the line 2—2 of FIG. 1, illustrating a wall panel.
Figure 3:
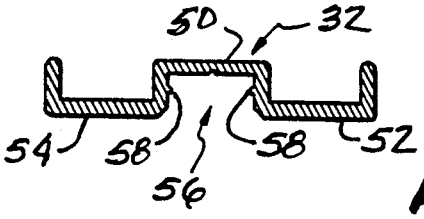
FIG. 3 is a transverse sectional view illustrating the profile of spline means.
Figure 4:
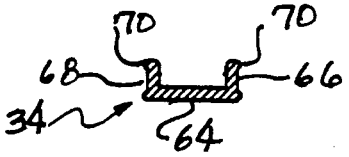
FIG. 4 is a transverse sectional view illustrating the profile of cap means.

FIG. 2 provides a horizontal cross-sectional view of each wall panel 24; and FIGS. 3 and 4 provide cross-sectional views of spline means 32 and cap means 34. For a complete description of the wall panel 24, the spline means 32 and the cap means 34, reference is directed to the aforesaid copending application Ser. No. 07/607,526 which is incorporated herein by reference.

For the purposes of the present invention, it is believed sufficient to state that, with reference to FIG. 2, each of the wall panels 24 comprises a cover plate 36 having inner and outer faces 38, 40 and opposite vertical edges 42. Rail means 44 are secured to the inner face 38 along the vertical edges 42 of the cover plate 32. Similar rail means are provided along the upper and lower edges of the cover plate 36. The rail means 44 present vertical recesses 46, 48 open at and extending inwardly from the vertical edges 42. As will be described, the recesses 46, 48 are adapted to receive an arm of the spline means 32.

Referring to FIG. 3, the vertical spline means 32 comprises a plate 50 having U-shaped arms 52, 54 extending from opposite longitudinal edges thereof, and a central exterior depression 56 defined by the plate 50 and the arms 52, 54. Projections 58 provided on the confronting interior faces of the central depression 56 serve to retain the cap means 34 connected to the vertical spline means 32.

Referring to FIG. 4, the cap means 34 has a U-shaped configuration including a web 64 and opposite sides 66, 68 presenting projections 70 at the remote ends thereof. The projections 70 interact with the projection 58 (FIG. 3) of the vertical spline means 32 to retain the cap means 34 in capping relation with the central depression 56, as shown in FIG. 7.

Figure 7:
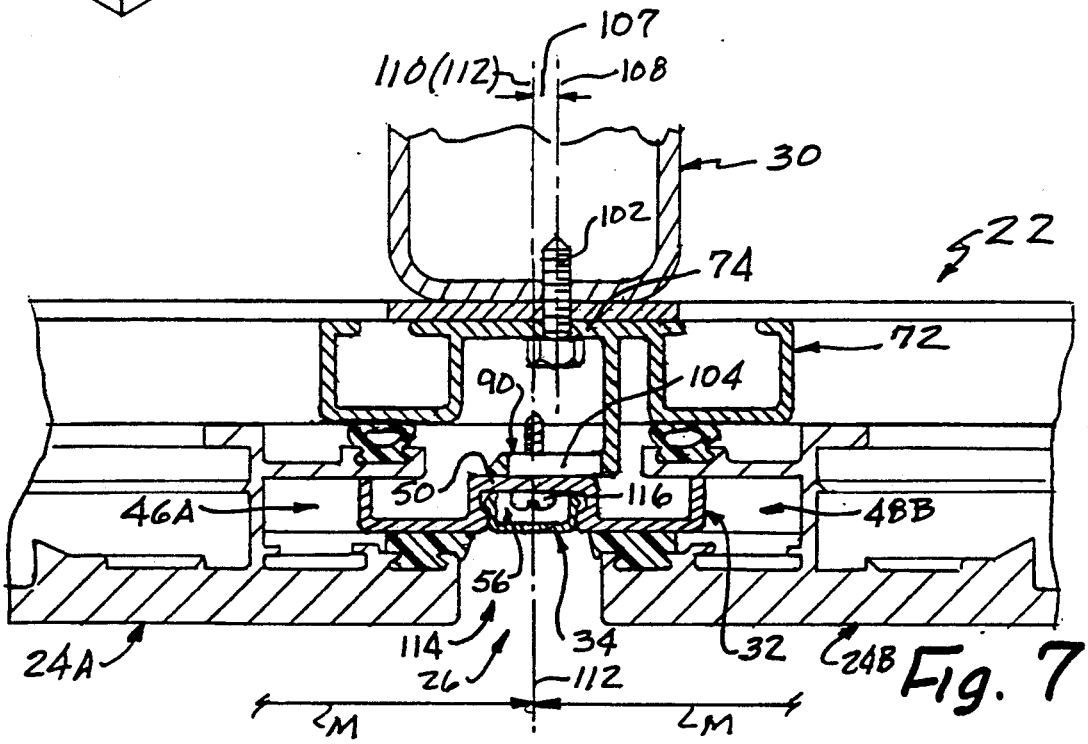
FIG. 7 is a cross-sectional view taken along the line 7—7 of FIG. 1, illustrating a panel joint incorporating the vertical frame member of FIG. 5.

As shown in FIG. 7, horizonally adjacent panels 24A, 24B, at the joint 26, are spaced apart and present a gap 114 therebetween. The gap 114 has a certerline 112. The arrangement is such that the spline means 32 in symetrically disposed about the gap centerline 112 and as a result the cap means 34 and spline fastener 116 are accessible through the gap 114. Because the width W (FIG. 1) of the panels 24 is fixed, the certerlines 112 of adjacent joints 26 are fixed at a modular spacing M (FIGS. 1 and 7).

Figure 5:
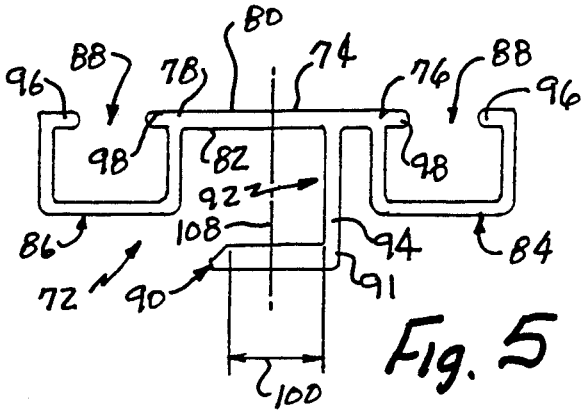
FIG. 5 is an end view of a vertical frame member.

As indicated earlier, the present invention provides vertical frame means adapted to accommodate lateral misalignment between the frame means and the spline means 32. In the preferred arrangement, vertical frame means 72 (FIG. 5) is provided comprising a central plate 74 having opposite sides 76, 78 and inner and outer faces 80, 82. U-shaped arms 84, 86 are provided, each connected along one of the opposite edges 76, 78. The U-shaped arms 84, 86 have open ends 88 adjacent to the inner face 80. Flange means 90 is provided which is spaced from and generally parallel with the central plate 74 and is positioned intermediate of the U-shaped arms 84, 86. Connecting means 92 is provided connecting the flange means 90 to the central plate 74. In the preferred embodiment, the connecting means 92 comprises a web 94 extending from an edge 91 of the flange means 90 to the central plate 74. The web 94 spaces the flange means 90 outwardly beyond of the U-shaped arms 84, 86. Additionally, each of the U-shaped arms 84, 86 presents opposed inturned lips 96, 98 defining the open ends 88. As shown in FIG. 5, each inturned lip 98 comprises an extension of the central plate 74. As will become apparent in connection with the description of FIG. 7, the flange means 90 has a width indicated by the dimension line 100 which is sufficient to accommodate the aforesaid lateral misalignment. In the preferred arrangement, the width 100 is sufficient to provide a lateral adjustment of about ± one quarter of an inch (±0.635 cm.).

Figure 6:
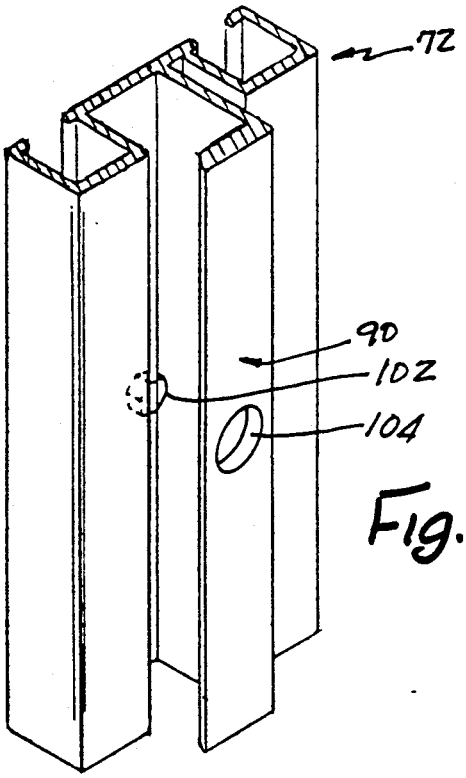
FIG. 6 is an isometric view of the frame member of FIG. 5.

Referring to FIG. 6, the vertical frame means 72 is secured to supporting steel by fastener means 102. Fastener mean 102 are provided at each end of the vertical frame means 72. Should the vertical frame means 72 exceed about four feet (1.22 M), fastener means 102 is provided at the center of the vertical frame means 72. Aperture means 104 is provided in the flange means 90 through which the fastener means 102 is installed.

FIG. 7 illustrates one of the joints 26 between adjacent wall panels 24A, 24B. FIG. 7 illustrates a situation wherein the vertical frame means 72 has been inadvertently secured to the vertical column 30 at an offset location. That is, the vertical frame means 72 is offset by a distance indicated at 107 and represented by the spacing between the centerline 108 of the frame means 72 and the coincident centerlines 110(112) of the column 30 and the gap 114. It will be appreciated that the fastener means 102 and the installing tool, e.g., socket wrench, may pass through the aperture 104 in the flange means 90, when securing the frame means 72 to the column 30. It will also be appreciated that since the web 94 (FIG. 5) is offset from the frame means centerline 108, only a single fastener means 102 is required at each fastening location.

As shown, the spline means 32 is symmetrically disposed about the centerline 112, having its U-shaped arms 52, 54 engaging the recesses 48B, 46A, respectively. The spline means 32 is secured in position by the fastener means 116 passing through the plate 50 of the spline means 32 and the flange means 90. As readily observable, the width 100 (FIG. 5) of the flange means 90 permits the spline means 32 and the fastener 116 to be displaced into symetrically disposed relation about the centerline 112. It is also readily observable that the cap means 34 and the fastener means 116 are readily accessible through the gap 114.

Alternative embodiments of the vertical frame means will now be described with reference to FIGS. 5 through 13. Corresponding numerals will be employed to identify corresponding parts heretofore described.

Figure 8:
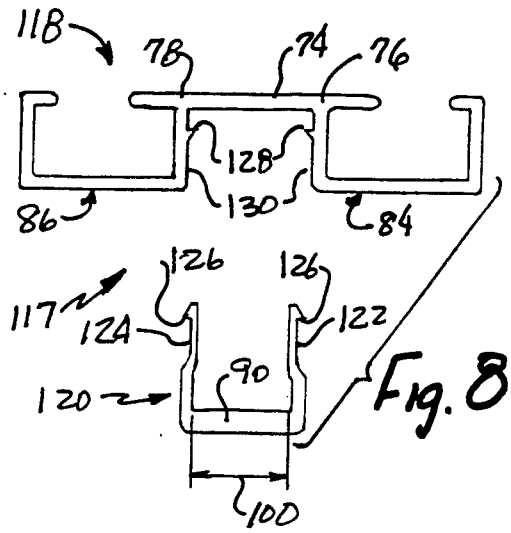
FIG. 8 is an end view of a two-piece vertical frame member.

FIG. 8 illustrates a two-piece vertical frame member 117 including frame means 118 and clip means 120. The frame means 118 and clip means 120 preferrably are substantially coextensive in length. The vertical frame means 118 comprises a central plate 74 having U-shaped arms 84, 86 along the opposite edges 76, 78 thereof. The flange means 90 is provided as an element of clip means 120. The clip means 120 includes webs 122, 124, each connected to one of the opposite longitudinal sides of the flange means 90. The webs 122, 124 extend toward the central plate 74 and terminate in outwardly directed hooks 126 The frame means 118 provides complimentary hooks 128, each engageable by one of the outwardly directed hooks 126. The complimentary hooks 128 preferably are provided on opposed faces 130 of the U-shaped arms 84, 86.

Figure 9:
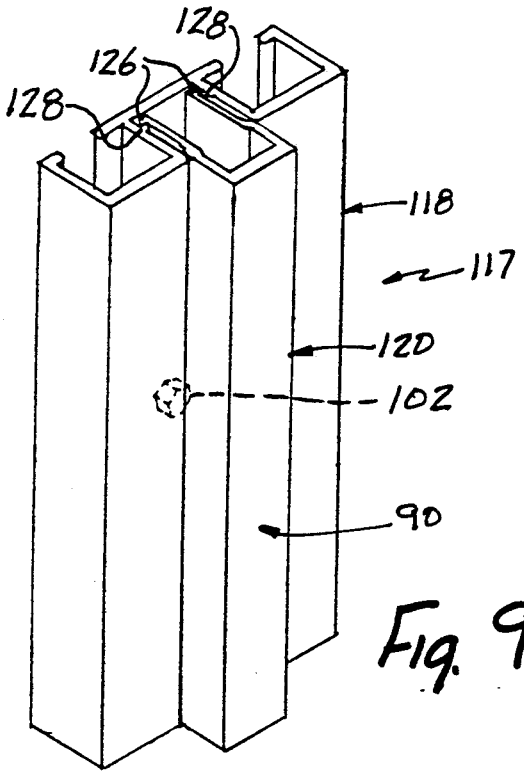
FIG. 9 is an isometric view of the assembled vertical frame member of FIG. 8.
Figure 10:
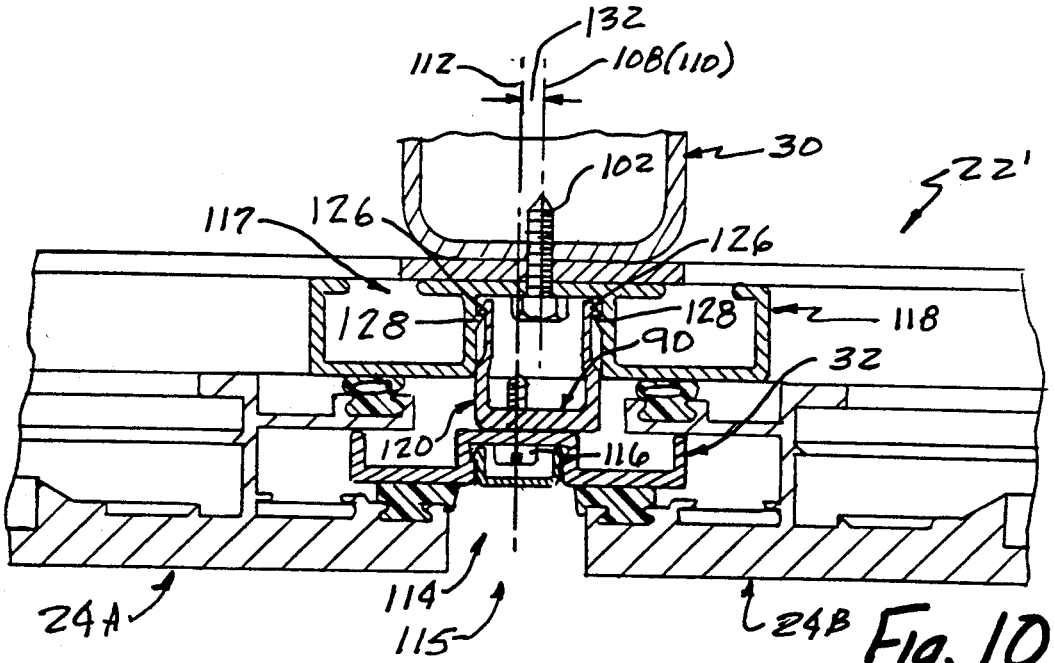
FIG. 10 is a view similar to FIG. 7, illustrating a panel joint incorporating the vertical frame member of FIG. 8.

As in the preferred embodiment, the frame means 118 is secured to column 30 at each fastening location by one of the fastener means 102 shown in dotted outline in FIG. 9. As shown in FIGS. 9 and 10, the clip means is snapped into place and is retained therein by the outwardly directed hooks 126 engaging the complimentary hooks 128.

FIG. 10 illustrates a wall structure 22' incorporating the two-piece vertical frame member 117. FIG. 10 illustrates the situation wherein in the column 30 is laterally offset from the joint 115. That is, the centerline 108 of the vertical column 30 is offset from the centerline 112 of the joint 115 by a distance indicated at 132. In FIG. 10, the two-piece frame member 117 is symmetrically disposed about the centerline 108 of the column 30. It will be appreciated that the width of the flange means 90 permits the spline means 132 to be symmetrically disposed about the centerline 112 of the joint 115 and to be secured thereto by fastener means 116.

Figure 11:
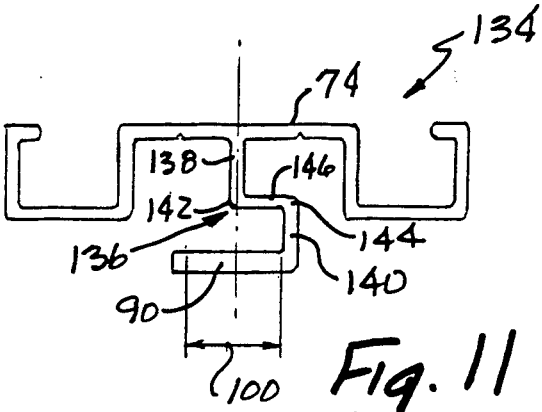
FIG. 11 is an end view of a further alternative frame member.

FIG. 11 illustrates a further alternative embodiment of frame means 134 wherein the connecting means 136 connects the flange means 90 to the central plate 74. In this embodiment the connecting means 136 comprises laterally offset webs 138, 140. The web 138 is connected to the central plate 74 whereas the web 140 is connected to the flange means 90. The laterally offset webs 138, 140 terminate in adjacent ends 142, 144 which are connected by a web segment 146 preferably disposed generally parallel to the flange means 90.

Figure 12:
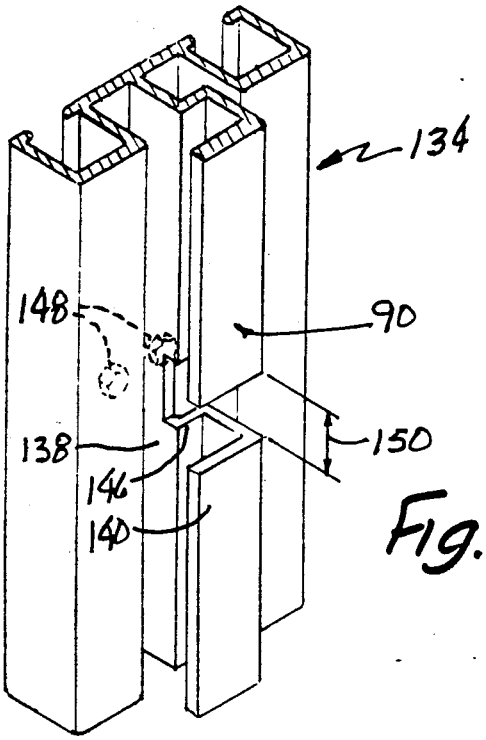
FIG. 12 is an isometric view of the frame member of FIG. 11.

As shown in FIG. 12, a portion of the flange means 90, the laterally offset webs 138, 140 and the web segment 146 are removed to provide an opening indicated at 150 to allow installation of the fastener means 148.

Figure 13:
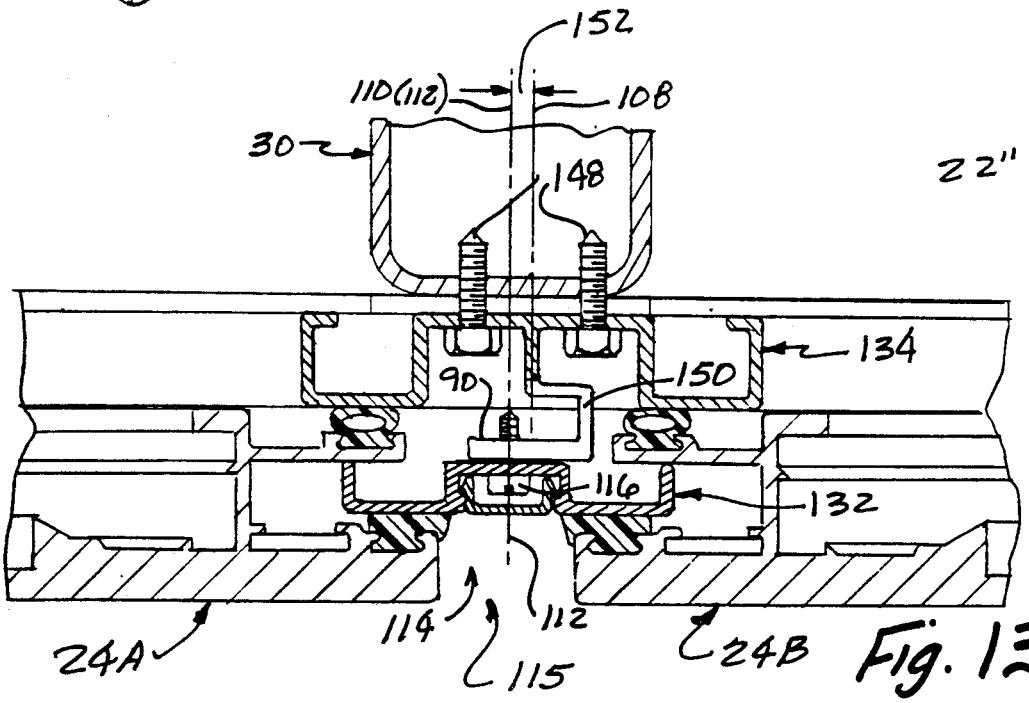
FIG. 13 is a view similar to FIG. 7, illustrating a panel joint incorporating the frame member of FIG. 11.

FIG. 13 illustrates a wall structure 22" and a situation similar to that shown in FIG. 7. That is, the centerline 110 of the column 106 and the centerline 112 of the joint 115 are coincident whereas the frame means 134 is laterally offset such that its centerline 108 is spaced from the centerlines 110(112) by a distance indicated at 152. Again, the width of the flange means 90 allows the spline means 32 to be symmetrically disposed about the centerline 112 of the joint 115 and to be secured thereto by the fastener 116. In this embodiment, two of the fastener means 148 are employed at each fastening location.

It should be readily apparent from the foregoing that the present invention provides a novel arrangement for accommodating misalignments between the vertical gap presented by horizontally adjacent panels and the supporting steel; provides an arrangement which maintains the spline means, the spline fastener means, and the cap means centered with respect to and accessible through the gap; and provides vertical frame means utilizing fewer fastener means to secure the same to supporting steel.

I claim:

1. In a vertical joint between horizontally adjacent wall panels of a wall structure, comprising said panels having inner and outer faces, and presenting spaced-apart vertical edges with a vertical gap therebetween; means at said vertical edges of said inner face providing vertical recesses open at and extending inwardly of said vertical edges; vertical spline means spanning across said vertical gap, engaging said vertical recesses, and being movable out of engagement with either of said recesses thereby releasibly retaining said panels; the improvement comprising:

fastening means accessible through said gap, releasibly securing said vertical spline to structure inboard of said wall panels; and said structure including vertical flange means extending laterally of and parallel to and in flush engagement with said spline means and secured thereto by said fastening means, said flange means having means sufficient to accommodate lateral adjustment between said vertical gap and said flange means.

2. The vertical joint as defined in claim 1 wherein said structure includes:

a vertical column;

vertical frame means secured to said column; and connecting means connecting said flange means to said vertical frame means.

3. The vertical joint as defined in claim 2 wherein said connecting means comprises:

a vertical web extending between said vertical flange means and said vertical frame means.

4. The vertical joint as defined in claim 2 wherein said connecting means comprises:

a Z-shaped vertical web extending between said vertical flange means and said vertical frame means.

5. The vertical joint as defined in claim 2 wherein said connecting means comprises:

vertical webs, one extending inwardly from each edge of said flange means toward said frame means, each of said web having a hook at its remote end; and complimentary hooks, each engaged with one of said hooks of said vertical webs.

6. A frame member for use in a curtain wall structure having a plurality of panels, said frame means comprising:

a central plate having opposite sides and inner and outer faces;

U-shaped arms, each connected to one of said opposite sides and extending away from said outer face, sand U-shaped arms having open ends adjacent to said inner face;

flange means spaced from and generally parallel with said central plate and intermediate of said U-shaped arms, said flange means having means sufficient to accommodate misalignment between said panels; and connecting means connecting said flange means to said frame member.

7. The frame member as defined in claim 6 wherein said connecting means connects said flange means to said central plate.

8. The frame member as defined in claim 6 wherein said flange means is spaced outwardly from said U-shaped arms.

9. The frame member as defined in claim 6 wherein each of said U-shaped arms presents opposed inturned lips defining said open end.

10. The frame member as defined in claim 9 wherein one of said inturned lips of each of said U-shaped arms comprises an extension of said central plate.

11. The frame member as defined in claim 6 wherein said connecting means comprises:

a web extending from said flange means to said central plate.

12. The frame member as defined in claim 6 wherein said connecting means comprises:

said flange means having opposite flange edges;

webs, each connected to one of said flange edges and extending toward said central plate and terminating in outwardly directed hooks; and complimentary hooks, each arranged to be engaged with one of said outwardly directed hooks.

13. The frame member as defined in claim 12 wherein each of said complimentary hooks are provided by one of said U-shaped arms.

14. The frame member as defined in claim 6 wherein said connecting means comprises:

laterally offset webs, one connected to said central plate and one connected to said flange means, said laterally offset webs terminating in adjacent ends; and a web segment connecting said adjacent ends.

15. The frame member as defined in claim 14 wherein said web segment is generally parallel with said flange means.

* * * * *